US007842164B2

(12) United States Patent
Rasheed et al.

(10) Patent No.: US 7,842,164 B2
(45) Date of Patent: Nov. 30, 2010

(54) PAPER AND MATERIALS AND PROCESSES FOR ITS PRODUCTION

(75) Inventors: Ahmed Atef Rasheed, Alexandria (EG); John Graham Langley, West Yorkshire (GB)

(73) Assignee: Amcol International Corporation, Hoffman Estates, IL (US)

( * ) Notice: Subject to any disclaimer, the term of this patent is extended or adjusted under 35 U.S.C. 154(b) by 338 days.

(21) Appl. No.: 11/959,096

(22) Filed: Dec. 18, 2007

(65) Prior Publication Data

US 2008/0289787 A1 Nov. 27, 2008

Related U.S. Application Data

(63) Continuation of application No. 10/506,104, filed as application No. PCT/GB03/00914 on Mar. 4, 2003, now abandoned.

(30) Foreign Application Priority Data

Mar. 4, 2002 (EP) ..... 02251485

(51) Int. Cl.

| | |
|---|---|
| ***C07D 307/60*** | (2006.01) |
| ***C08L 3/00*** | (2006.01) |
| ***D21H 17/05*** | (2006.01) |
| ***D21H 17/28*** | (2006.01) |
| ***D21H 21/16*** | (2006.01) |

(52) U.S. Cl. ..... 162/175; 162/158; 162/185; 106/162.1; 106/218; 106/238; 549/233

(58) Field of Classification Search ..... 162/158, 162/175, 185; 106/162.1, 218, 238; 549/233
See application file for complete search history.

(56) References Cited

U.S. PATENT DOCUMENTS

| | | | | |
|---|---|---|---|---|
| 5,969,011 | A * | 10/1999 | Frolich et al. | 524/35 |
| 6,306,255 | B1 * | 10/2001 | Frolich et al. | 162/158 |
| 6,576,049 | B1 * | 6/2003 | Dilts et al. | 106/219 |

* cited by examiner

*Primary Examiner*—Eric Hug
*Assistant Examiner*—Dennis Cordray
(74) *Attorney, Agent, or Firm*—Marshall, Gerstein & Borun LLP

(57) ABSTRACT

Paper is made by providing an anionic aqueous emulsion of a size, usually a reactive anhydride size, and mixing it into a cellulosic suspension prior to drainage of the suspension to form a sheet which is then dried to provide paper (including paper board). The emulsion is preferably stabilised wholly or mainly by 0.5 to 30 parts by weight (per part by weight size) of water soluble, anionic, polymeric stabiliser, which is preferably anionic starch. Alternatively, the emulsion may be added to the cellulosic suspension while it is anionic, before mixing retention into it. The emulsion may be added to the cellulosic suspension after cationic retention aid has been added to it, the emulsion being added with, before or after mixing anionic microparticulate material or other anionic bridging aid, prior to drainage of the suspension.

20 Claims, No Drawings

PAPER AND MATERIALS AND PROCESSES FOR ITS PRODUCTION

This application is a CON of U.S. application Ser. No. 10/506,104, filed Jan. 26, 2005, now ABANDONED, which is a 371 of PCT/GB03/00914, filed Mar. 4, 2003.

This invention relates to internally sized paper. The invention includes a process for making internally sized paper, materials for use in the process, and paper obtainable by the process. The term "paper" includes paper board.

Paper is conventionally made by providing an anionic cellulosic suspension, mixing cationic retention aid into this, draining the suspension through a wire to form a sheet, and drying the sheet. In some processes (referred to below as "microparticulate" processes) anionic bridging agent (often bentonite, colloidal silica or other anionic microparticulate material) is mixed into the suspension after the cationic retention aid and before draining the suspension.

In order to reduce the absorbency and/or permeability of the paper to aqueous inks and other liquids it is conventional to render the paper more hydrophobic by applying a size.

When the paper is to be sized, size may be applied as an external size on to the sheet (before or after drying the sheet to provide paper), or the size may be applied as an internal size by incorporation of the size into the cellulosic suspension before draining.

Internal sizing has various advantages including the fact that it is conducted as part of the wet end process and does not necessitate post-treatment of the sheet. However it suffers from the disadvantage that it is usually difficult or impossible to achieve high levels of internal size in the paper. In practice the amount of internal size in conventional printing paper (e.g., grammage up to 150 gsm) is usually not above about 0.3%, based on the dry weight of the paper. This restricts the ability to obtain optimum sizing results.

There are various ways of indicating the extent of sizing and different tests give different indications of effectiveness. Two frequently used tests are the Cobb test and the Hercules test. These are discussed in more detail below.

In conventional sizing and paper-making processes, the initial cellulosic suspension, and the fibre in it, is anionic. The internal size is water insoluble and so has to be emulsified, and it is important that the emulsified size should be trapped on the fibres in the sheet.

The standard practice is to add a cationic emulsion of the size to the anionic cellulosic suspension, with the intention that the emulsified size is then attracted to and substantively held on the anionic fibres. Thereafter, conventional cationic retention aid is added so as to cause flocculation of the solids (including the fibres on which the size particles are substantively retained) in conventional manner. The cationic emulsion of the size is made by emulsifying the size in the presence of a cationic stabiliser for the emulsion and adding this to the anionic cellulosic suspension.

In order that the cationic retention aid is an effective flocculant, it is necessary that the cellulosic suspension to which the cationic size emulsion has been added should still be sufficiently anionic, and still have a sufficiently high cationic demand, that the conventional cationic retention aid is effective. Accordingly there is a limit on the amount of cationic size emulsion which can be added without interfering with other aspects of the conventional paper-making process. In practice it is often impracticable to add more than about 0.3 or 0.5% (based on the solids content of the suspension) of the active size in the form of a cationic emulsion.

It would therefore be desirable to be able to achieve improved uniformity of the distribution of size in paper at a given dosage, and it would also be desirable to be able to increase the dosage while retaining uniformity, without interfering with other aspects of the paper-making process.

Some sizes (for instance rosin sizes and ketene dimer sizes) form sufficiently stable cationic emulsions that they can be supplied to the mill in pre-emulsified form, or they can be emulsified at the mill. However optimum sizing generally requires chemical interaction between the size particles and the cellulosic fibres in the sheet. Unfortunately the sizes which can easily be provided as relatively stable cationic emulsions tend to cure in the sheet rather slowly. In practice therefore it is necessary to provide additional heat or time for curing and this is inconvenient. For instance quality control is difficult when the process requires time for post curing the sheet after leaving the machine.

The use of a reactive anhydride size has the advantage that the size cures rapidly, normally while still on the paper making machine, and this is one reason why reactive anhydride sizes are often preferred. However the provision of a cationic emulsion of an anhydride size creates other problems. This is because the anhydride size is liable to hydrolyse upon contact with the water into which it is emulsified, so as to form a dicarboxylic acid compound. This is then liable to interact with the cationic emulsion stabiliser to destabilise the emulsion and form a sticky complex. Once the cationic emulsion of anhydride size has settled or broken, it is generally impossible to re-emulsify it. The problem of hydrolysis increases as emulsion particle size decreases and it is stated in Principles of Wet End Chemistry by Scott, TAPPI Press 1996, page 107 that, because of hydrolysis, the optimum particle size of ASA emulsions is 1-2.mu.m, even though the particle size in theory could be down to 0.5.mu.m.

Accordingly, the anhydride size emulsion is generally made at the mill to a particle size of 1-2.mu.m and used promptly under conditions which ensure that there is no delay in the usage of the emulsion. It is therefore necessary to avoid any stagnant areas in the flow lines for the emulsion and to avoid any delays due to mill breakdowns. If the mill does break down, it may be necessary to dump the emulsion. It would therefore be desirable to provide ASA and other reactive sizes in the form of emulsions of greater stability.

Another problem with anhydride sizes is that it is particularly important to attain good retention of the emulsion particles in the sheet since if any significant amount of the emulsified size drains through the sheet it will enter the white water circuit and so can react with cationic retention aid in the white water, thus giving the opportunity for further formation of a sticky complex. It would therefore be desirable to minimise the formation of stickies in use.

In all the conventional processes, the size is introduced as a cationic emulsion in order that it is substantive to the anionic fibres in the cellulosic suspension, since conventional paper-making suspensions have a cationic demand and the fibres are in an anionic state. However in a few instances the cellulosic suspension does not have a cationic demand and, indeed, the suspension may itself be cationic.

Thus, in EP-A-418,015 (Albright & Wilson Limited) it is proposed to add an anionic emulsion of a ketene dimer reactive size to a cellulosic suspension which is cationic. The anionic suspension is made using surfactant and, inter alia, very small amounts of anionic polyacrylamide or anionic starch or large amounts of colloidal silica. Presumably the anionic size is then substantive to the cationic fibres in the cellulosic suspension. Subsequently an appropriate retention is added, and often this system involves pre-treatment with alum or other anionic material to promote its interaction with the subsequently added retention aid. The process of EP-A-

418,015 does not seem to have been widely adopted, probably because of the limited interest in cationic cellulosic suspensions and/or because of inadequate sizing properties.

In WO 00/49226, it is proposed that improved sizing can be obtained if a sizing emulsion is formed with cross linked starch instead of conventional starch. Although all the examples and specific description relate to the use of cross linked cationic starch it is stated that the starch can, alternatively, be anionic or amphoteric and that the choice of the type of substitution will depend on the composition of the cellulosic stock. Accordingly this is consistent with the suggestion in EP-A-418,015 that, when the cellulosic suspension is cationic, an anionic size emulsion can be added in conventional manner before the retention system is added.

In WO01/81678 a reactive size is emulsified in an aqueous dispersion of a polymer which is insoluble and is an unreactive size and which is stabilised by starch, preferably as a result of the insoluble polymer being formed in the presence of the starch and thus graft polymerised on to the starch. In order to achieve stability, the final solids content is preferably about 35 or 40%. It is warned that the emulsion should be formed at low temperatures to reduce the chance of unwanted reaction with water. Clearly therefore these emulsions are potentially as unstable as conventional aqueous emulsions of reactive sizes.

Microparticulate paper-making processes have many advantages as regards product quality, but they can result in increased material costs, due to the microparticulate addition. In EP-A-499-448 (Langley et al) a nonionic or anionic size emulsion is added to the cellulosic suspension after flocculation with the cationic retention aid, either with or before adding the anionic bridging agent. In theory the size should be highly substantive to the fibres, and well distributed in the final sheet, and the size particles should not only be well retained but they may even contribute to overall retention thereby allowing reduction in the amount of microparticulate material. In practice these benefits have not been obtained.

It is stated in EP 499,448 that the size emulsion can include oxidised starch and anionic emulsifying or dispersing agent, and in particular it is said to be preferred to use a low molecular weight anionic or nonionic emulsifier. The examples show the use of nonionic emulsions and the use of anionic emulsions formed of 95% ASA with 5% anionic phosphate emulsifier, 66% ASA with 7.5% anionic phosphate emulsifier and 26.5% of a copolymer of acrylamide and sodium polyacryate (as a reverse phase emulsion, thus including some oil), and 97% AKD with 3% naphthalene sulphonic acid.

In WO 96/17127 (Johanssen) and WO 97/31152 (Peutherer et al) a size emulsion is formed by interaction of the size with anionic microparticulate material. The resultant anionic emulsion of size and microparticulate material is added as part or all of the anionic bridging agent which is added to the suspension after the cationic retention aid.

When the size in these processes is an anhydride size, the processes have the advantage of avoiding the problems 20, of interaction between the anhydride size and the cationic stabiliser. Although satisfactory Cobb values are quoted in EP-A-499,448 and WO 97/31152, with additions to the suspension of as much as 3% size (based on the solids in the suspension), there is no indication of the average particle dimension of the size emulsion, the amount of size retained in the sheet or the Hercules values. The processes do not seem to have been widely adopted and this is probably because they do not appear to give sufficient advantage with respect to the ultimate sizing properties, especially in the Hercules test, probably due to poor size retention in the sheet and/or poor emulsion particle dimensions.

In addition to requiring good sizing properties in printing and other papers, it is also desirable to optimise the dry strength values. For this purpose it is conventional to make a separate addition of a dry strength resin to the cellulosic suspension before drainage.

One object of the invention has been to provide stable and very effective emulsions of all types of sizes. A particular object relates to the provision of stable anionic emulsions of reactive sizes, especially reactive anhydride sizes, so as to minimise the traditional instability and stickies difficulties associated with such sizes whilst obtaining good sizing results and maintaining the speed and other advantages of the use of such sizes.

Another object of the invention has been to provide a microparticulate process which allows for improved sizing and/or dry strength in an economic manner.

Another object has been to achieve papers having good dry strength properties in addition to the good sizing properties.

Another object relates to both microparticulate and other paper-making processes and has been to provide an improved internal sizing method whereby improved Hercules results can be obtained. This improvement can be due to improved distribution of the same amount of internal size as may have been applied in prior art methods and/or it may be due to the ability to introduce larger amounts of internal size without interfering with the paper-making process. The achievement of improved Hercules test results is a particularly significant sizing improvement.

The Hercules sizing test determines the time taken for an aqueous ink penetrant to permeate from one surface of the paper to the reverse surface under standardised conditions sufficient to achieve a standardised change in reflectance at the reverse surface. The quantitative result is quoted in seconds and so an increase in the quantitative result indicates improved sizing. The Hercules test is not very sensitive at low size dosages. In this specification, all Hercules results are determined in accordance with TAPP1-T530-om-96 wherein the ink penetrant has a dye concentration of 1.25% and a formic acid concentration of 1%.

The Cobb sizing test gives an indication of the overall hydrophobicity of the paper. It determines the quantity of water (grams per square meter) absorbed by the paper in a specified time and so the quantitative result indicates improved sizing. In this specification, all Cobb results are determined in accordance with TAPP1-T441-om-90. Although the Cobb test indicates overall hydrophobicity, it is not very sensitive at high size dosages and it does not give a good indication of the uniformity of the distribution of the size and this is indicated better by the Hercules test.

The absolute value in either test depends not only on the amount and quality of sizing but also on other characteristics of the paper, such as the type and amount of filler and fibre and the density of the paper. As a generality, however, where permeation resistance is required, it is meaningful to rely predominantly on the Hercules test and to select sizing conditions which give as high a value as is reasonably possible.

Typical writing papers (e.g., for manuscript writing, photocopying or printing papers) often have a grammage (oven dried) of 30 to 150 gsm and may need to have a Hercules value of up to about 150-200 seconds with values of below 100 being unsatisfactory, even though there may be substantially no difference between the Cobb values of the satisfactory and unsatisfactory papers. Thicker papers inevitably tend to have higher Hercules values and so packaging papers and boards, for instance having a grammage of 200 to 500 gsm or more, typically have a Hercules value of up to about 400 seconds.

It would be desirable to improve on these desirable Hercules values and it is, in any event, difficult to obtain these solely by existing internal sizing methods. This is because modification of existing methods so as to increase the amount of size with the intention of improving the Hercules value interferes with the conventional paper-making process and so is not acceptable. Accordingly, at present optimum Hercules values are usually obtained by a combination of internal sizing and external sizing, but this is inconvenient.

In one aspect of the invention we provide novel anionic size emulsions which are stable and are suitable for use in the internal sizing of paper, the size preferably being an anhydride size. In another aspect we provide processes of making internally sized paper using these emulsions. In some of these processes the emulsion is added after cationic flocculating agent but in other, particularly important, processes an appropriate anionic size emulsion (preferably one of the novel anionic size emulsions) is added into an anionic cellulosic suspension into which retention aid is subsequently added, followed by drainage of the suspension and drying of the resultant sheet.

All the processes in which the novel anionic size emulsions are used have the particular advantage that they solve the object of giving good internal sizing coupled with good dry strength. The anhydride size emulsions have the advantage that they are more stable than known anhydride emulsions and so reduce the problems of stickies and poor runnability. Processes in which the emulsion is added after cationic retention aid and in which anionic bridging agent is also added after the cationic retention aid solve the object of improving microparticulate processes both as regards overall retention and economy of the process and as regards achievement of a good combination of internal sizing and dry strength.

In one aspect of the invention, internally sized paper is made by mixing an anionic emulsion of a size into an anionic cellulosic suspension, then adding retention aid to the suspension and thereby flocculating the suspension, draining the suspension to form a sheet, and drying the sheet. This process achieves the object of providing an improved internal sizing method whereby improved Hercules results can be achieved, preferably accompanied by good dry strength properties.

In this process, the cellulosic suspension is anionic at the time the size is added to it as an anionic emulsion, and the resultant suspension is then subjected to an appropriate retention procedure so as to produce a sheet.

The anionic cellulosic suspension can be any conventional cellulosic suspension, either filled or unfilled, wherein the fibres are anionic, in conventional manner. Accordingly the suspension should not be one which has been pre-treated with a large amount of cationic filler or cationic polymer, or which contains significant cationic impurities, such that it is not an anionic suspension.

One indication that the suspension is anionic is that the suspension has a cationic demand, namely it can be flocculated successfully by a cationic retention aid. Suitable retention aids are described in more detail below.

In practice a preferred way of ensuring that the suspension to which the emulsion is added is anionic is to select a suspension having a cationic demand. The cationic demand (expressed in mV) can be determined using a Mutek measuring streaming current wherein the zero charge point is reached by addition of a cationic titre.

An alternative indication that the suspension is anionic is that its zeta potential is negative. If the zeta potential is zero or positive then the suspension does not have a cationic demand. If the zeta potential is negative then the suspension is essentially an anionic suspension and the fibres in the suspension are anionic.

As a result of adding the anionic size emulsion to the anionic suspension, the suspension will become slightly more anionic. Accordingly the cationic demand of the suspension (before the addition of the anionic emulsion) can be quite low since the emulsion will increase its receptivity to the subsequently added cationic retention aid. If desired, the anionicity of the emulsion can be selected to be high (for instance by using a highly anionic stabiliser) so as to increase the cationic demand of the cellulosic suspension after the emulsion has been added to it.

The cellulosic suspension may be formed from any suitable anionic cellulosic fibres, including recycled paper. The suspension may contain conventional additives such as neutral or anionic fillers and may be formed from conventional anionic pulps.

The suspension may have been pre-treated with cationic material, for instance if the pulp was particularly dirty and so contained anionic residues, or if large amounts of anionic size are to be added or if highly anionic size is to be added, but the amount of any pre-addition of cationic material should be kept sufficiently low that the resultant suspension is still anionic at the time the anionic size emulsion is added to it. Suitable cationic materials for the pre-treatment of dirty pulps are known and include polyaluminium chloride and other polyvalent cations, and low molecular weight water soluble polymers such as polyethylene imine, polyamines, cationic epichlorhydrins, and low molecular weight versions of the cationic retention aids discussed below.

The suspension may be a thick stock (for instance having a solids content of above 2%, e.g., 2.5 to 5%) but preferably it is a thin stock (for instance having a solids content of 0.3 to 1.5 or 2%) at the time the emulsion is added. If it is a thick stock, then the suspension is usually subsequently diluted to a thin stock before drainage, and this dilution to a thin stock can occur either or before or after adding the retention aid.

The anionic emulsion of size which is used in this process is preferably a substantially stable emulsion in water of 1 part by weight size and at least 0.1 or 0.2 parts by weight of substantially water soluble, anionic, organic, stabiliser. This emulsion must be anionic and preferably is substantially free of cationic material. The amount of the stabiliser is usually at least 0.5 parts by weight and often at least 0.8 parts by weight. The amount is generally at least 1 or at least 2 parts by weight per part by weight of size. The amount of stabiliser can be as much as 10, or even 20 or 30 parts by weight but is usually not more than 5 parts by weight. Satisfactory results are generally obtained with around 1.5 or 2 parts up to around 3, 4 or even 5 parts by weight stabiliser per part by weight size.

The stabiliser used in the invention is preferably a water-miscible or water-soluble liquid or a substantially water soluble solid in the sense that it can be provided as a stable solution (which may be colloidal) in water, either hot or cold. The stabiliser is preferably prepared by dissolving or diluting bulk stabiliser into cold or hot water or other aqueous liquid, i.e., without any previous provision of an emulsion or other suspension of the stabiliser in a non-aqueous liquid.

Any compound, or mixture of compounds, can be used as stabiliser if it will provide an anionic size emulsion which has suitable physical and chemical stability. The stabiliser can consist of or include low molecular weight or monomeric anionic emulsifier, such as naphthalene or ligno sulphonates or surfactants, alone or blended with nonionic surfactant or other non-ionic emulsifier. However, this may result in some of the low molecular weight material going into the white water and this is undesirable and the emulsion may not be as satisfactory in the invention as is desired.

Accordingly it is particularly preferred to use a size emulsion (preferably an anhydride size emulsion) which is stabilised wholly or mainly (and preferably only) by a substantially water soluble, anionic, organic, polymeric stabiliser where the polymer has a molecular weight of above, for instance, 1000 and more usually above 3000 and preferably above 10,000, as discussed below.

Broadly therefore the emulsions which are preferably used in the process of the first aspect of the invention are anionic emulsions of a size (preferably a reactive size, especially an anhydride size) in water stabilised wholly or mainly by 0.5 to 30, preferably 1 to 10, parts by weight (per part by weight size) of water soluble, anionic, polymeric stabiliser selected from water soluble synthetic polymers (preferably copolymers) and naturally occurring polymers or anionically modified naturally occurring polymers. These emulsions are novel.

By saying that the emulsion is stabilised wholly or mainly by the polymeric stabiliser we mean that the emulsion is preferably substantially free of any stabiliser which is not a polymeric stabiliser but that if any stabiliser having a molecular weight below 1000 is present it should only be included in a non-interfering amount and the total amount of such stabiliser is usually not more than 1%, or at the most 2%, by weight of the emulsion. Preferably the anionic, water-soluble, polymeric stabiliser is the only stabiliser in the emulsion.

The polymeric stabiliser should be anionic so that it either promotes the anionic nature of the emulsion particles or, if they are already anionic, does not significantly detract from the anionic nature of the emulsion particles. Usually the stabiliser contains anionic groups, generally acidic groups in wholly or partly neutralised form.

It is desirable that the stabiliser should be preferentially substantive to the particles of the size emulsion when the stabiliser, size and water are physically mixed together. As a result, the polymer concentrates on the surface of the emulsion particles during or after the mixing and thereby stabilises the particles. Thus the effect may be considered to be comparable to micelle formation or coacervation around the anhydride size. Coacervation materials and conditions may therefore be used for forming the emulsion.

In order to optimise interaction between the size and the stabiliser, preferably the stabiliser is a substantially water soluble, anionic, material which contains acidic groups (so as to ensure that eventual particles are anionic) and which also contains groups which can interact or even chemically react (either ionically or covalently) with the size so as to promote association of the stabiliser with the surface of the size particles. When the size has carboxylic groups, preferably the stabiliser is a compound which contains one or more hydroxyl groups (to esterify the carboxylic groups) and one or more acidic groups (to provide the anionic character). Most preferably the compound is a polyhydroxy polyacidic compound which is preferably a polymer or oligomer. The hydroxy groups can then react with acidic groups on the size. This is particularly valuable when the size is an anhydride size.

The acidic groups in a suitable stabiliser may be, for instance, sulphuric or sulphonic acid groups but are preferably phosphoric acid or carboxylic acid groups. Preferably the groups are in the form of water soluble alkali metal or ammonium or other salts.

Suitable anionic polymeric stabilisers are substantially water soluble synthetic anionic polymers of ethylenically unsaturated monomers and preferably are copolymers which preferably contain hydroxylic and/or acidic groups and substantially water soluble hydrolysed derivatives of various anionic, naturally occurring or chemically modified, cellulosic, starch or other carbohydrate compounds. Suitable chemically modified, naturally occurring polymers, are those which have been subjected to a simple modification for instance to convert starch to anionic starch.

The use of synthetic polymers having a sufficiently high molecular weight (for instance above 3000 and generally above 5000, preferably above 10,000 and most preferably above 15,000 or 20,000) or natural polymers such as starches or cellulosic polymers is particularly advantageous because the stabiliser can promote dry strength of the resultant paper as well as facilitating the production of a stable emulsion. Anionic starches, and anionic polyacrylamides having molecular weight preferably above 10,000 or 15,000, such as copolymers of acrylamide with acrylic or methacrylic acid (and optionally copolymerised with a hydroxy monomer), and other anionic dry strength resins are therefore particularly preferred because they will provide both stability to the emulsion and dry strength to the paper. Anionic starches and other polymers may be cold water soluble or may require cooking in hot water in order to provide a solution.

The stabilisers which are currently preferred are anionic starches because they are effective stabilisers, economically readily available, and can promote the dry strength of the paper. The anionic starches may be starches which, after cooking, are substantially water soluble and which have a molecular structure which is substantially linear, i.e., free of deliberately added cross links. However if desired the starch can be cross linked, for instance as described in WO 00/49226. The anionic starch can be a substantially naturally occurring anionic starch (such as potato, maize, wheat or tapioca starch) and the starch may have been chemically modified to increase its anionic content, for instance to increase its content of carboxylate, sulphate, sulphonate, phosphate, phosphonate or other anionic groups in known manner.

Particularly preferred anionic starches for use in the invention are oxidised starches, carboxymethyl starch and starch phosphates such as mono-starch phosphate. Suitable materials are available under the trade designations Cerestar 5566 (a maize starch from wCerestar), Raisamyl 302 (a potato starch from Rasio Chemicals), and Retabond and Aniofix from A.V.B. The starch is usually supplied in an uncooked state and preferably it is cooked, for instance by treating in boiling or near boiling water, in conventional manner in accordance with manufacturer's instructions. After cooling, the resultant solution is used for forming the emulsion.

The size emulsion typically has a negative zeta potential of above 5, and often above 10 or 20, Mv. For instance one suitable emulsion had a zeta potential of −31 mV even though the size itself had a zeta potential of only −3 mV.

The size emulsion generally contains 0.2 to 5%, often around 0.5 to 2%, of the size based on the total weight of emulsion, together with the desired amount of polymeric stabiliser. This amount may be merely sufficient to give the required stability but may be in excess of this, so as to provide extra dry strength benefits. Typically it is from 0.2 to 30% based on the emulsion. Usually it is at least 0.5 or 1% and preferably it is 1.5-5%, although amounts of up to 10 or 20% are often suitable.

The emulsion is preferably prepared by providing an aqueous solution of the stabiliser and then emulsifying the size into that using any suitable homogeniser. It is desirable that the polymeric stabiliser should be homogeneously distributed in water before homogenising the size with it, and so simple blending of, for instance, water with size and with a liquid dispersion of polymer particles in oil is not satisfactory.

The solution of the polymeric stabiliser is preferably a true aqueous solution but, if desired, it may be a colloidal solution or, less preferably, a colloidal suspension. The solution of stabiliser may be formed by dissolving preformed polymer in water or by dispersing hydrolysable polymer in water and then hydrolysing the polymer in the water in order to form a solution of water-soluble polymer. Cooking starch is an example of such a process.

The solution of the stabiliser into which the size is emulsified is preferably free of any polymeric components which are water insoluble. Preferably there is no other sizing component in the emulsion at the time when it is formed by homogenising the anhydride or other size into the solution of the stabiliser.

The use of anionic starch (or other appropriate anionic polymeric stabiliser) in the preferred large amounts of, for instance, at least one part stabiliser per part size greatly facilitates the formation of a small particle size, stable, emulsion. For instance a typical Waring Blender or kitchen blender can generate, when using sufficient of a suitable anionic starch, a stable emulsion having an average particle size of around 0.5.mu.m even after only 2 to 4 minutes blending. This is in contrast to the fact that emulsifying the same size with cationic starch or other cationic emulsifier generally requires at least 10 minutes blending to get down to a particle size of around 1.mu.m.

The preferred emulsions are not only formed very easily but they also have good chemical and physical stability. Thus on standing there may be some settlement of the emulsion to reveal a supernatant, but there is no breakage of the emulsion because simple stirring or shaking restores the system to an emulsion substantially the same as the one that was formed initially. For instance a preferred characteristic of emulsions according to the invention is that they can be allowed to stand for 8 hours at 20.degree. C., and often 1 day, 1 week, 3 weeks or more, and at the end of the standing period they are still stable. By this we mean that they have either not settled or destabilised at all or have settled to reveal a supernatant but can be restored as uniform emulsions, having substantially the same particle size as when fresh, merely by simple shaking or stirring.

The preferred emulsions are emulsions wherein the particles of the emulsion have an average dimension of below 750 nm, preferably below 600 nm. It may be as low as 100 nm or 200 nm but is often in the range 300 to 500 nm. Average dimension is the average particle size as recorded using, for instance, a Malvern zeta sizer 3000. Average is therefore the weight average. Such emulsions can be formed easily using the preferred materials and the described method of preparation. In particular, the production of emulsions having the desired low particle size is facilitated by using a sufficiently large amount of the anionic starch or other stabiliser.

The sizes which can be used in the invention can be conventional, relatively unreactive, sizes such as rosin or fortified rosin sizes or stearate, fluorocarbon or wax sizes. Generally, however, the sizes are reactive sizes. The reactive size may be a ketene dimer size but is most preferably a reactive anhydride size, for instance an alkenyl succinic anhydride (ASA) size, since the invention solves the instability, stickies and runnability problems which are traditionally associated with these, whereas none of the prior art does. The provision of emulsions of such sizes which have the stability defined above is of particular value.

Preferably the emulsion contains reactive anhydride size as the only size, but if desired other sizes can be blended into the emulsion after achieving the stable emulsion of the anhydride size, provided such other sizes do not cause destabilisation of the emulsion.

The temperature and pH at which the emulsion is formed can influence the properties of the emulsion and so it may be necessary to optimise the temperature and pH in order to optimise the precise conditions depending on the amount and type of size and stabiliser. The carboxylate or other anionic groups may be in the free acid form but are often present in the form of alkali metal or ammonium salt groups. Often the homogenisation and emulsification is conducted at a temperature in the range 30 to 90.degree. C., often 40 to 50.degree. C. up to 70 or 80.degree. C.

It appears that the preferred emulsions have the anionic size particles effectively coated or encapsulated or protected by an outer film of anionic polymer. This probably inhibits the tendency of the particles to hydrolyse (this being especially valuable when the size is an anhydride size). It also inhibits the tendency for undesired premature reaction between the anhydride or other size and the cationic polymer subsequently added to the suspension, or present in the white water. It also reduces the risk of anionic polymer draining through the sheet. It also ensures that the particles are anionic even though uncontrolled hydrolysis of the size (for instance as is liable to occur with anhydride size emulsions unless the various precautions discussed above are taken) has been avoided.

The stable, small particle size emulsions stabilised by anionic polymeric stabiliser in a relatively large amount, and their production, are novel and are a second aspect of the invention.

The preferred emulsions of the invention are emulsions of anhydride sizes, preferably ASA, wherein the average particle size is below 1 mm and is preferably in the preferred amounts specified above, and wherein the emulsion is stabilised by anionic starch and/or substantially water soluble linear or cross linked anionic synthetic polymer and wherein the amount of anionic starch and/or other polymer is within the ranges specified above, preferably 2 to 5 parts anionic starch per part by weight ASA size.

In the processes of the invention wherein both the emulsion and the suspension are anionic, the described internal sizing process does not suffer from the disadvantage of prior art processes whereby the addition of increased amounts of the emulsified size interferes with the subsequent effectiveness of the retention aid.

Other components can be added to adjust the character of the cellulosic suspension after adding the anionic size and before adding the retention aid, if appropriate. Preferably, however, it is unnecessary to adjust the suspension in this manner and, instead, a retention aid is added which is suitable for promoting retention in the sheet of the fibres and other suspended particles in the treated cellulosic emulsion.

Despite the cellulosic suspension being anionic and having a cationic demand, there are a few instances where satisfactory retention is achieved using a retention aid which is non-ionic or anionic, for instance as described in WO 95/02088, or where a dual polymer (anionic and then cationic) can be used. However preferred processes of the invention are those in which the only retention aid (or the first retention aid which is added) is cationic, since in most instances this generally optimises the benefits of the suspension being anionic.

If non-ionic or anionic polymer is being added as part of the retention system, it may be satisfactory if the anionic size emulsion is added at the same time as this retention aid.

It is desirable to ensure that cationic retention aid is not added with or sufficiently close to the anionic size emulsion that the retention aid interacts with the size particles before they are substantially uniformly mixed throughout the suspension since it is desirable to have as uniform a distribution as possible of the size particles throughout the suspension and, therefore, throughout the resultant sheet.

The cationic retention aid can be selected from any conventional cationic retention polymer such as cationic starch, and polymers of cationic monomers such as diallyl dim ethyl ammonium chloride, or dimethyl or diethyl aminoethyl-acrylate, -methacrylate, -acrylamide or -methacrylamide or acrylamido- or methacrylamido-propyl trimethyl ammonium chloride. The cationic ethylenic monomers are usually present as acid addition salts or quaternary ammonium salts.

The retention aid polymers are preferably copolymers of such cationic monomers with acrylamide and so are cationic polyacrylamides. The polymers may be wholly water soluble and have intrinsic viscosity above 4 dl/g, often above 7 dl/g. The polymers may be linear or branched polymers. They can alternatively be in the form of partially cross linked polymers, generally in the form of a reverse phase dispersion. For instance an aqueous solution formed from the dispersion may appear to have an intrinsic viscosity of at least 2 dl/g, and preferably at least 4 dl/g. Suitable polymers are described in EP-A-202,780, 235,893 and 374,458.

The cationic retention aid may be the only material which is added to the suspension to achieve flocculation and thus retention of the fibres and size particles during drainage. Often, however, an anionic bridging agent is added to the suspension after the retention aid and before drainage, so that the overall process is a "microparticulate" process.

The retention aid causes flocculation and the resultant flocs tend to break down as they are pumped, through the system before drainage, and anionic bridging agent is then added to bridge between them. The breakage of the initial flocs can be achieved as a result of a deliberate shear stage whereby the initial flocs are broken down into microflocs, or the breakage of the initial flocs can occur simply due to pumping through the system. Often the cationic polymer is added before the last point of high shear, for instance just before the centri screen, and the anionic bridging agent is added after the last point of high shear, for instance at the head box.

The anionic bridging agent can be an organic polymer. This may be a solution of organic polymer, for instance an anionic polyacrylamide, or a cellulose, or lignosulphonate. Instead of being truly soluble, anionic polymer may be partially cross linked, for instance as a reverse phase dispersion of partially cross linked polymer particles. Alternatively the polymer can be added as substantially wholly cross linked polymer particles.

Often, however, the bridging agent is an inorganic microparticulate material. This may be bentonite, that is to say a swelling clay for instance as described in U.S. Pat. No. 4,753,710. Instead of a swelling clay, it can be a silica sol such as described in U.S. Pat. No. 4,388,150. Instead of this, it can be a polysilisic acid micro gel (which itself may be alternatively described as a polysilicate or alumino silicate micro gel), for instance as described in U.S. Pat. Nos. 4,927,498, 4,950,420, 5,176,891 and 5,279,827.

The suspension is then drained through a screen in conventional manner to form a wet sheet which is then dried to form the desired paper. This may be subjected to coating procedures during or after drying, in conventional manner.

The amount of cationic retention aid will be selected in conventional manner having regard to the suspension which is to be drained and is typically in the range 0.01 to 0.3%, often around 0.02 to 0.1 or 0.15%, based on the dry weight of this suspension. These amounts are usually appropriate for conventional cationic polymeric retention aids. Higher amounts, e.g., up to 3% are sometimes required.

When anionic bridging agent is included, the optimum amount can be determined by routine experimentation in conventional manner and is generally in the range 0.01 to 0.5%, often around 0.05 to 0.3%, based on the dry weight of the suspension.

The amount of the anhydride or other size will be selected to give the degree of sizing required having regard to the particular paper which is being produced. The amount of anhydride or other size is generally in the range 0.05 to 2% based on the dry weight of the suspension. Usually the amount is at least 0.1% and often at least 0.2%. Often the amount is not more than 0.3% but an advantage of the invention is that it is possible to use larger amounts than are conventional, for instance above 0.5% and up to 0.7%, 1% or 1.5% without adversely interfering with the effectiveness of the cationic retention aid.

This first aspect of the invention (wherein the anionic emulsion of size is mixed into an anionic cellulosic suspension) results in remarkably good sizing results as well as good fibre retention. The starch or other polymer can also promote dry strength. The good sizing is manifested particularly when assessed by the Hercules test.

Thus, by this aspect of the invention, it is possible to obtain paper having remarkably efficient internal sizing. Thus it is now possible, for the first time, to produce paper which has a Hercules resistance to permeation due to the internal size of above 400 seconds, and often above 600 seconds, for all normal paper weights or, when the paper has a grammage of not more than 150 gsm, of above 200 seconds and often above 300 seconds. These papers are novel.

A very important advantage of the emulsion aspect of the invention is that the emulsion, even when based on ASA or other anhydride size, is stable with the result that reasonable delays in use after initial manufacture or reasonable delays on the machine do not result in the size causing blockages on the machine and/or stickies problems on the machine.

In particular, the emulsion aspect of the invention allows the attainment of all the advantages of ASA sizing (such as rapid cure and good sizing results) whilst avoiding the disadvantages (such as emulsion instability and stickies) and even allows for improved results due to the ability to incorporate larger amounts of ASA as an internal size than has previously been possible in a practical manner to give good Hercules sizing results.

The emulsion aspect of the invention is therefore broadly applicable to all processes of making internally sized paper (including paper board) which comprise mixing a size emulsion into a cellulosic suspension, mixing retention aid into the suspension before, with or after mixing the size emulsion into the suspension, and draining the suspension to form a sheet and drying the sheet. Thus, in addition to the described processes in which the anionic size emulsion is added into an anionic cellulosic suspension, the invention also provides processes in which the anionic size emulsion is added to the cellulosic suspension (thin stock or thick stock) at any other stage prior to drainage.

Particularly preferred processes of this type are the "microparticulate processes" in which the cationic retention aid is mixed into the suspension and then anionic bridging agents is mixed into the resultant suspension and the anionic size emulsion is also added after the cationic retention aid. The anionic size emulsion may be added before the anionic bridging agent, with the anionic bridging agent or after the anionic bridging agent. For instance the anionic size emulsion and the anionic bridging agent can both be added in the head box immediately prior to the drainage. Preferably the anionic bridging agent is a swelling clay. Accordingly this aspect of the invention modifies the disclosure of EP-A-0499448 by using the novel emulsions in preference to the various emulsions-described in more detail in that and which are stabilised wholly or significantly by non-polymeric stabilisers.

ASA and other anhydride size emulsions prepared using only, or primarily non-ionic or anionic surfactants, as descried in EP-A-499,448, have very limited physical stability, and are prone to rapid hydrolysis, particularly if the particle size is very fine, i.e., 0.5 micron or below, leading to a rapid loss in sizing efficiency. Also, the anionic surface charge density of these emulsions is relatively low compared with the ASA size emulsions, stabilised with the higher molecular weight anionic polymers according to the invention. This is particularly the case when the stabilising polymer is anionic starch.

Presumably, the extra colloidal stability of the ASA and other anhydride size emulsions, prepared according to the invention, provides substantial protection against premature hydrolysis of ASA, thereby providing improved sizing efficiency, and enhanced physical and chemical stability. This is amply illustrated by the fact that ASA emulsions stabilised with anionic potato starch, prepared according to the invention, provided a very stable emulsion, and even after 3 weeks standing, the particle size and the sizing efficiency remained the same as freshly prepared emulsion.

The fine particle size, and the highly anionic charge density of the size emulsions, prepared according to the invention, also appears to contribute positively to the anionic component of the micro-articulate retention systems, such that the size emulsion acts as an extender to the anionic component of micro-particulate retention systems, and contributes synergistically to retention of the size in the sheet leading to the exceptional sizing results that can be achieved.

The cationic retention aids and the anionic bridging agent, and the overall process conditions, may all be as described above, except for the addition of the size emulsion at the head box or at some other position after the cationic retention aid and before drainage.

The advantage of this type of process is that it gives an improved combination of overall retention in the microparticulate process and of distribution and retention of size and of attainment of good dry strength.

The following technical examples illustrate preferred aspects of the invention. In particular, these examples illustrate the preparation of anionic emulsions according to the invention and comparative anionic and cationic emulsions which are not in accordance with the invention. The examples also illustrate four different processes of making paper, both by hand sheet techniques and by pilot plant machine techniques.

In test A, the process adds an emulsion according to the invention added to an anionic cellulosic suspension just before the addition of cationic retention aid.

In test B an emulsion according to the invention is added after the cationic retention aid, and so uses the same order of addition as in EP-A-499,488.

Test C, and the poor emulsion used in that, is a comparative example broadly in accordance with the disclosure in WO97/31152.

In test D, a comparative cationic emulsion was used in accordance with conventional practice, namely by being added to the anionic cellulosic suspension before the addition of the cationic retention aid.

ASA Emulsions Preparation

Anionic Emulsion (for Tests A and B)—According to the Invention 500 ml of 2% anionic potato starch slurry was prepared according to producer's laboratory preparation method by cooking in water at 95.degree. C. for 30 minutes, followed by dilution to 2% concentration. Liquid ASA was added in an amount to give 1% ASA and 2% anionic starch in the mixture. The mixture was transferred into Waring blender container and mixed for 4 minutes. The resultant emulsion average particle size, as recorded with Malvern zeta sizer 3000 was 500 nm. There was no tendency for an oily layer to accumulate on the blender.

After three weeks storage, the emulsion had substantially the same particle size (indicating-physical stability) and had substantially the same sizing performance in use as the freshly made emulsion (indicating chemical stability).

When the process was repeated using an ASA:starch ratio of 1:1 the size was 0.9 .mu.m and at a ratio of 1:5 the size was 0.4.mu.m.

Bentonite-Stabilised Emulsion (for Test C)—Comparative 500 ml of 0.5% bentonite slurry was prepared, 1 liquid ASA added and the mixture transferred into Waring blender container and mixed. There was a tendency for an oily deposit to accumulate on the blender and so mixing was continued for 10 minutes.

The presence of bentonite particles in the emulsion prevented obtaining a meaningful particle size distribution measurement of the size particles, but the distribution appeared to include particles up to 2.mu.m or more.

Conventional Cationic Emulsion (Test D)—Comparative 500 ml of 3% cationic potato starch slurry was prepared according to producer's laboratory preparation method, by cooking as above. 1% ASA was added and the mixture was transferred into Waring blender container as above. There was a tendency for an oily deposit to form. Mixing was conducted for 10 minutes. The resultant emulsion average particle size as recorded with Malvern zeta sizer 3000 was 900 nm.

Handsheet Trial

Handsheets were made according to TAPPI official test method T-205 SP-95 with the exception of increasing the sheet grammage (overdried) from 1.2 g to 1.5 g, equivalent to about 63 gsm.

The furnish was a 50/50 mixture of softwood and hardwood beaten in a valley beater to a Schopper Reigler wetness of approximately 40 SR. 20% (based on weight of fibres) precipitated calcium carbonate (PCC) was added.

The furnish was then diluted to 0.5 wt % and had a Mutek cationic demand.

300 ml of the furnish was taken and transferred to a 1000 ml glass beaker and mixed at 500 rpm for 30 seconds.

Cationic polyacrylamide retention aid was added at 0.05 wt % (based on furnish solids), and after 10 seconds the mixer speed was increased to 1500 rpm for 40 seconds. The mixer speed was then lowered to 500 rpm and 0.2 wt % bentonite (based on furnish solids) was added and allowed to mix for 10 seconds.

In tests A and D the sizing emulsion (ratio 1:2, particle size 0.5.mu.m) was added and, after 15 seconds mixing, the cationic retention aid was added. In test B the emulsion was added after the cationic polyacrylamide and shortly before the bentonite was added. In test C the emulsion was added at the same point as the bentonite addition.

The handsheets were made according to TAPPI procedure until they were placed in the drying rings. The drying rings were then stacked and placed under heavy weight in an oven at 105.degree. C. for 2 hours. This was to mimic the paper machine conditions.

Pilot Plant Trial

The furnish made for the trial was 55% hardwood, 25% softwood, and 20% PCC and had Mutek cationic demand. First component retention aid was high molecular weight cationic polyacrylamide, and bentonite was used as anionic microparticulate bridging aid.

70 gsm paper was produced on the machine at speed of 10 m/min and a rate of 350 OD solids/min. The circulating system was kept open (meaning that all the retained, fibres, fines, filler, and sizing emulsion were first pass retained into the produced paper).

In test A, the ASA emulsion was added early into the thick stock, followed by the cationic polyacrylamide in the thick stock before the conical refiner, and finally the late addition of bentonite slurry in the thin stock at the mixing box. Size-free sheet was first produced, followed by the addition of different doses of the ASA anionic emulsion. Each dose was continued for 10 minutes of production.

In Test B, the same anionic size emulsion was added into the thin stock in the mixing box (after the addition of the cationic polyacrylamide) followed by the addition of bentonite.

In Test C (comparative), the bentonite ASA emulsion was added into the thin stock at the mixing box.

In Test D (comparative), the cationic ASA emulsion was added at the same position as was used for the anionic emulsion in Test A, but overall retention was so poor at dosages of above 0.3% ASA that those trials were not completed.

Sizing Tests

All hand-sheets and machine trial sheets were tested for their degree of sizing with both Cobb test and the Hercules test in accordance with TAPPI standard methods T-441 om-98 and T-530 om-96 respectively.

The results are shown in the following table. In this table the Cobb values are in gsm and indicate the amount of water absorbed in the specified time (60 seconds) and so the lowest quantity values are best. The Hercules values are in seconds and indicate the time required for a dye solution to penetrate the paper, and so the highest values are best.

The overall running of processes C and D was inferior to tests A and B.

The white water samples collected during the runs showed high fines and fillers retention values for tests A, B, and C by determining their solid content. Test D retention values showed poor retention at higher dosages of cationic sizing emulsion.

Handsheets Tensile Strength

Anionic starch-ASA emulsions were prepared as described above with 1% ASA and differing amounts of the anionic starch, up to 4%.

Handsheets were made at constant ASA dosage (0.3% based on dry furnish solid content) and with the different emulsions in the same manner as described previously. The produced sheets were kept in conditioned lab for 24 hours (minimum). The handsheets were formed for tensile testing in accordance with TAPPI method T 205 sp-95. Then the tensile properties were tested using constant rate of elongation apparatus made by Instron Corporation, series IX, automated Material Testing System in accordance with official TAPPI testing procedure T494 om-96.

The results shown in the following table demonstrate the effect of different anionic starch dosages based on the furnish dry solid content, on the tensile strength of the handsheets at constant ASA content in the formed emulsion.

| Anionic starch content (%) | Tensile Strength (kN/m$^2$) |
|---|---|
| 0 | 1.20 |
| 1 | 1.37 |
| 2 | 1.49 |
| 3 | 1.68 |
| 4 | 1.87 |

The tensile results show the benefit of the anionic starch sizing emulsion as a dry strength additive in the produced handsheets, by increasing the amount of anionic starch in the make-up slurry of the emulsion.

| | ASA dosage % | | | | | | | | | |
|---|---|---|---|---|---|---|---|---|---|---|
| | Handset | | | | | Pilot Machine | | | | |
| | 0.1 | 0.2 | 0.3 | 0.4 | 0.5 | 0.1 | 0.2 | 0.3 | 0.4 | 0.5 |
| Cobb Values | | | | | | | | | | |
| A | 114 | 22 | 16 | 12 | 12 | 110 | 25 | 18 | 15 | 14 |
| B | 130 | 119 | 74 | 40 | 38 | 116 | 104 | 57 | 44 | 37 |
| C | 126 | 114 | 64 | 35 | 31 | 140 | 136 | 130 | 76 | 66 |
| D | 120 | 102 | 59 | 68 | 79 | 122 | 110 | 65 | — | — |
| Hercules Values | | | | | | | | | | |
| A | 1 | 80 | 370 | 700 | 1300 | 1 | 54 | 325 | 02 | 1180 |
| B | 1 | 42 | 140 | 320 | 470 | 0 | 2 | 10 | 25 | 60 |
| C | 1 | 45 | 180 | 360 | 550 | 0 | 0 | 3 | 39 | 70 |
| D | 1 | 8 | 55 | 45 | 49 | 3 | 10 | 8 | — | — |

The A values are in accordance with the preferred process invention and clearly demonstrate the benefits of that invention, especially as regards rate of ink permeation (Hercules test).

The near linear relationship between anionic starch content of the emulsion and tensile strength of the paper indicates that the emulsion continues to be retained and that the starch is not going into the white water

The invention claimed is:

1. An anionic aqueous emulsion of size stabilized wholly or mainly by 1.5 to 30 parts by weight (per part by weight size) of water soluble, anionic, polymeric stabilizer which is anionic starch and wherein the average particle size of the emulsion is below 750 nm.

2. An emulsion according to claim 1 in which the size is a reactive size.

3. An emulsion according to claim 2 in which the size is an anhydride size.

4. An emulsion according to claim 3 in which the anhydride size is the only size in the emulsion.

5. An emulsion according to any preceding claim obtainable by homogenizing the size into an aqueous solution of the water soluble polymeric stabilizer and thereby forming an emulsion in which the amount of size is 0.2 to 5% by weight of the emulsion.

6. An emulsion according to claim 1, 2, 3 or 4 which is an emulsion of 0.2 to 5% of the size in water containing 0.5 to 20% (by weight of the emulsion) of anionic starch.

7. An emulsion according to claim 1, 2, 3 or 4 having an average particle size of below 600 nm.

8. A process of making internally sized paper (including paper board) comprising mixing an anionic aqueous size emulsion according to any of claims 1 to 4 into a cellulosic suspension, mixing a retention aid into the suspension before, with or after mixing the size emulsion into the suspension, draining the suspension to form a sheet, and drying the sheet.

9. A process of making internally sized (including paper board) comprising a cationic retention aid into a cellulosic suspension, and then mixing the size emulsion of claim 1, 2, 3 or 4 and an anionic bridging agent into the suspension, and the suspension is then drained to form a sheet and the sheet is dried.

10. A process according to claim 9 in which the anionic bridging agent is an anionic microparticulate material.

11. A process according to claim 8 in which the anionic size emulsion is mixed into the cellulosic suspension while the cellulosic suspension is anionic, and the retention aid is subsequently mixed into the suspension and the suspension is thereby flocculated, and the flocculated suspension is drained to form a sheet and the sheet is dried.

12. A process according to claim 11 in which the anionic size emulsion is mixed into an anionic thinstock suspension.

13. A process according to claim 12 in which an anionic bridging agent is mixed into the suspension after the cationic retention aid and before the suspension is drained.

14. An emulsion according to claim 2 obtainable by homogenizing the size into an aqueous solution of the water soluble polymeric stabilizer and thereby forming an emulsion in which the amount of size is 0.25 to 5% by weight of the emulsion.

15. An emulsion according to claim 5 which is an emulsion of 0.2 to 5% of the size in water containing 0.5 to 30% (by weight of the emulsion) of anionic starch.

16. An emulsion according to claim 5 having an average particle size of below 600 nm.

17. An emulsion according to claim 6 having an average particle size of below 600 nm.

18. A process of making internally sized paper (including paper board) comprising mixing an anionic aqueous size emulsion according to claim 5 into a cellulosic suspension, mixing retention aid into the suspension before, with or after mixing the size emulsion into the suspension, draining the suspension to form a sheet, and drying the sheet.

19. A process of making internally sized paper (including paper board) comprising mixing an anionic aqueous size emulsion according to claim 6 into a cellulosic suspension, mixing retention aid into the suspension before, with or after mixing the size emulsion into the suspension, draining the suspension to form a sheet, and drying the sheet.

20. A process of making internally sized paper (including paper board) comprising mixing an anionic aqueous size emulsion according to claim 7 into a cellulosic suspension, mixing retention aid into the suspension before, with or after mixing the size emulsion into the suspension, draining the suspension to form a sheet, and drying the sheet.

* * * * *

UNITED STATES PATENT AND TRADEMARK OFFICE

CERTIFICATE OF CORRECTION

PATENT NO. : 7,842,164 B2
APPLICATION NO. : 11/959096
DATED : November 30, 2010
INVENTOR(S) : Ahmed A. Rasheed et al.

It is certified that error appears in the above-identified patent and that said Letters Patent is hereby corrected as shown below:

On the Title Page:

At Item (30), "02251485" should be -- 02251485.5 --.

At Claim 9, Column 17, line 30, "comprising a" should be -- comprising mixing a --.

Signed and Sealed this
Twenty-sixth Day of July, 2011

David J. Kappos

David J. Kappos
*Director of the United States Patent and Trademark Office*